US005121510A

United States Patent [19]

Ricalde Medina

[11] Patent Number: 5,121,510

[45] Date of Patent: Jun. 16, 1992

[54] DOUBLE VALVE WATER DISCHARGE UNIT FOR WATER CASINGS OR TANKS

[76] Inventor: Carlos A. Ricalde Medina, Agustin Melgar No. 1085, Esq. con Francisco Marquez Col. Chapultepec Culiacan, Sinaloa, Mexico

[21] Appl. No.: 594,747

[22] Filed: Oct. 9, 1990

Related U.S. Application Data

[63] Continuation-in-part of Ser. No. 228,015, Aug. 3, 1988, abandoned.

[51] Int. Cl.[5] ..... E03D 3/12

[52] U.S. Cl. ..... 4/326; 4/324

[58] Field of Search ..... 4/324, 327, 393, 403, 4/405

[56] References Cited

U.S. PATENT DOCUMENTS

| | | | |
|---|---|---|---|
| 1,767,043 | 6/1930 | Blaun et al. | 4/326 |
| 1,871,579 | 8/1932 | Bashara | 4/403 |
| 1,960,864 | 5/1934 | Brown | 4/326 |
| 2,839,759 | 6/1958 | Martino | 4/326 |
| 2,864,095 | 12/1958 | Martino | 4/326 |
| 2,964,095 | 12/1960 | Hoffman, Jr. et al. | 297/89 |
| 3,117,323 | 1/1964 | Corsaw | 4/400 |
| 3,154,794 | 11/1964 | Antunez, Jr. | 4/393 |
| 3,795,016 | 3/1974 | Eastman | 4/326 |
| 3,947,900 | 4/1976 | Duke | 4/326 |
| 4,056,856 | 11/1977 | Reld et al. | 4/326 |
| 4,096,591 | 6/1978 | Awis | 4/426 |
| 4,173,801 | 11/1979 | Bresnyan | 4/326 |
| 4,189,795 | 2/1980 | Conti et al. | 4/324 |
| 4,353,138 | 10/1982 | Bell | 4/326 |
| 4,504,984 | 3/1985 | Burns | 4/326 |
| 4,829,605 | 5/1989 | Agostino | 4/326 |

*Primary Examiner*—William A. Cuchlinski, Jr.
*Assistant Examiner*—W. Morris Worth
*Attorney, Agent, or Firm*—Ladas & Parry

[57] ABSTRACT

A water optimizing system comprising a single or double water flush assembly and an activation mechanism for maximum and minimum water flush. The flush assembly of the system includes a threaded discharge pipe capable of being raised and lowered selectively in order to adjust the level of the water to be flushed, and an adjustable threaded connection, which allows the valve seat of the flush assembly to be adjusted to determine the volume of water in the tank necessary to operate the optimizing system more efficiently.

30 Claims, 7 Drawing Sheets

DOUBLE VALVE WATER DISCHARGE UNIT FOR WATER CASINGS OR TANKS

This is a continuation-in-part of copending application Ser. No. 07/228,015 filed on Aug. 3, 1988.

BACKGROUND OF THE INVENTION

The invention is related to a water optimizing system for toilets that includes a maximum or minimum water flush multiadjustable assembly provided with one or two flushing units for this purpose and an also adjustable overflow pipe provided for each flushing valve.

As a result of the urgent need to save and optimize as much as possible the water used in toilets with a water reception tank, different water saving systems have been developed, among which it is possible to find systems that operate with two total or partial water flush levels, and the most common those that evacuate the toilet with a single flushing valve located near the bottom of the tank. The latter single systems are fixed and lack fixtures that allow them, for example, to raise the valve seat to reduce to the necessary minimum the optimum flush volume of water contained in the tank, consequently, with these systems, almost all the water volume in the tank is invariably flushed. In the systems that allow total or partial flushing of the tank water in some cases, as in the U.S. Pat. Nos. 2,839,759; 1,960,864 and 2,964,095, the height of the upper valve seat can be regulated due to the threaded coupling of such seat with the flush passage. In these systems, however, the seat of the lower valve cannot be adjusted and therefore, when the corresponding handle is activated, practically the entire content of liquid is drained from the tank.

Each different toilet model has the capacity to evacuate optimally a certain volume of water. This volume depends directly on the maximum height of the upper level of water in the tank. Thus, the higher, the level, the lesser volume of water required. Once said volume is defined it can be regulated until it is optimized via a adjustable water flush system.

After having observed the behavior of the water flushing in several hundred operating toilets, it was discovered that in several dozens of a single model, most of these toilets required a different volume of water to evacuate efficiently, in spite of the fact that they were identical, this difference even being up to four liters more in comparison with the toilet that showed the most economy. In all cases, the volume of water required was less in proportion to the greater slope or vertical drop of the drainage.

Obviously, conventional toilet models that operate with a single flush passage are not capable of optimizing the volume of water needed to fulfill their purpose since because of their fixed nature with respect to the bottom of the tank, as well as the immobility of their valve seats, they lack adjustability. These models always flush the same volume of water -almost the whole contents of the tank- which, in most of cases, is more than the water needed for efficient operation.

In the case of toilets that operate with a total or partial flush system, although the partial discharge may be regulated, total discharge in these systems has the same inconvenience as those with a single valve, since none of those known or described in the U.S. Pat. Nos. 2,864,095; 1,960,864; 2,839,759; 4,173,801; 4,353,130; 4,056,856; 4,829,605; 1,767,043; 4,504,984 and 4,096,591, offers the possibility of adjusting the water volume of the total flush because the lower valve is invariably fixed. All these patents refer to a double discharge systems, as in the case of this invention in one of its embodiments, with the exception of the systems described in U.S. Pat. No. 1,960,864; 2,839,759 and 2,864,856, which are capable of adjusting their upper water level; the rest of the double flush systems of the above-mentioned patents, once installed, cannot optimize the water discharge to the toilet bowl.

With the system of this invention, the disadvantage of the systems in use is solved by means of flush passages provided with threads for threaded coupling with their respective valve mouths or seats which are also threaded, and by which the discharge water level can be adjusted for each case, that is, when the maximum flush or the minimum flush handle is activated. It will be noted that throughout the description of this invention, it is mentioned "maximum" or "minimum" flush, and this is due to the fact that this system does not provide total flush of the water contained in the tank. As will be observed in the attached drawings, the level of the lower valve is farther from the tank bottom than in the case of double flush systems similar to this invention. It can be thereby secured that the water volume below the height of the discharge mouth or seat of the lower valve will not be drained, avoiding water waste.

In addition to the possibility of adjusting the height of the flushing valves in this system, alternatively, adjustment thereof is obtained via threaded portion in the discharge pipe that allows it to raise or lower selectively in order to adjust the height of the system from the junction with the tank bottom. None of the present systems of one or two valves offers this possibility, even though in some of them a similar threaded portion is shown which, however, only serves to fix the system to the bottom of the tank and not to make its adjustment possible with the aim of optimizing the water flush.

On the other hand, in the models proposed in the corresponding previous art, it can be seen that they do not offer the possibility of choosing between the use of a single valve or a double valve system. The specific construction, in the majority of cases rather complex, of double valve systems, in which the two valves are integral to a tubular piece, requires the user to employ this system obligatorily, regardless of whether the toilet, for reasons of drainage, may only require a conventional single valve system that is necessarily cheaper than a double one.

Another inconvenience of the double valve systems of the mentioned patents is that because of their integral structure, the damage that may occur, for example, in one of the valves, or in the tubular piece that supports them, makes it necessary to do without both and buy a new system. This means that it is not possible to remove only the damaged part from the system.

With the water discharge system of this invention, conceived to be structured in a modular form, the installer or purchaser is given the opportunity to choose a two valve system using a valve communication chamber to which are connected by threads two identical valve assemblies, or a single valve system that does not use the mentioned chamber. In either case, the height of the flushing valve(s) can be adjusted as required by the toilet conditions.

Another structurally important and economically advantageous difference of the system here proposed with respect to the prior systems is the construction of its components in the form of substantially identical modules, in the case of damage to one of the parts avoiding total substitution of the system by replacing only the component -for example, the valve seat, the valve itself, the water discharge pipe or the valve communicating chamber- that is not optimum operating conditions. This naturally represents an unquestionable benefit for the purchaser.

Another feature that makes the flush system of this invention functionally and technically different from those previously proposed is that in the maximum and minimum flush embodiment each valve assembly has its own overflow pipe that is integral to the tubular portion whose upper end is the valve seat. Given the different adjustability options of the system, each overflow pipe has its own adjustable element consisting of a tubular section that is coupled by threading and that in turn adjust the height of said overflow pipe so that its upper end is slightly above the maximum water level in the tank.

The incorporation of valve assemblies having their own overflow pipe in the system here claimed constitutes another innovation to related systems, since the double vent allows, when the water is displaced through either of the two flush mouths, the air inside the discharge passages to be displaced outside of them via the overflow pipe of the valve that has not been activated, thereby avoiding the nonactivated valve tends to become unplugged by pneumatic pressure caused by the air displaced by the discharge of water. It is believed to be possible that at least in some of the double valve systems developed before, the provision of a single overflow pipe favors the involuntary "lifting" of the non-activated valve due to the mentioned pneumatic pressure.

In addition to the foregoing, the overflow pipe of the system here proposed incorporates as an integral part a projection at a particular point of its length where there is fastened in a pivotal manner one end of the bar that is connected by its opposite end to the valve that seals the corresponding discharge orifice. The projection is also shaped in a way that serves as a stop limiting the ascending pivotal movement of the said valve lift.

With respect to the flushing valves of the already known systems, it is observed that there are several types of them like those with a flat sealing surface whose sealing position is sloped, and others with a horizontal seating whose sealing surface is conical or spherical. Contrary to these, the flushing valve model inherent in the system of this invention has the characteristic that while being flat, it is horizontal and consists of a body of rigid material to be operated without deformations, which incorporates in its section contacting the valve seat a resilient sealing ring that when compressed by the water pressure seals the union of the valve with its respective seat.

The system's valve is also distinguished by a lower protuberance that serves as guide and ballast in a form similar to some models already proposed previously, tut in contrast to them the valve body and the protuberance are hollow and made of a single piece. These features make the floating of the valve notably efficient and the hydrodynamic protuberance does not obstruct the water discharge from the toilet bowl, nor does it become a water impact body that obliges the valve to descend. In contrast, the ball used as a guide and ballast element for the valve in the system of U.S. Pat. No. 3,117,323, when the said valve is activated, remains exactly in the discharge mouth, obstructing the flow of water that is being flushed.

SUMMARY OF THE INVENTION

It is a purpose of the invention to optimize the water flushed in toilets via a simple or double flushing system constituted by modular components capable of being adjusted in order to determine the water volume level that must be flushed both in a single valve system and in a double valve system.

It is another object of this invention to give the user the chance to choose between the use of a system with one adjustable flushing valve or a double valve system, each one also adjustable, depending on the specific needs of his toilet, without this option being at a greater cost than the alternatives already on the market.

A further purpose of the system claimed is that it allows adjusting the minimum volume of water needed for the toilet to operate efficiently, regulating the system "in situ" in a way that is also simple, until adapting it in accordance with the conditions of the local sewerage system.

An additional purpose of the invention is to make it possible to adjust the water volume that has to be evacuated from the tank, via a threaded adjustment mechanism in the tank bottom.

Added to the above purposes of the invention is providing a system with one or two flushing valves provided with multiple adjustment options of the flush water volume, but ensuring the sealing of the system with the corresponding sealing elements.

A further purpose of the invention here described is to provide a system that because of its modular construction offers the possibility of replacing only the parts that are damaged by use without having to throw away the complete system.

Still another purpose of the invention is the provision of a water optimizing system made up of substantially identical low manufacturing cost modular elements.

An additional purpose of the invention consists in the incorporation of a novel activation mechanism for the optimizing system in its double water discharge embodiment.

The above purposes of the invention will be made evident throughout the detailed description thereof, aided by the attached drawings which illustrate the features of the optimizing system in its two embodiments.

DETAILED DESCRIPTION OF THE INVENTION

Figure 1:
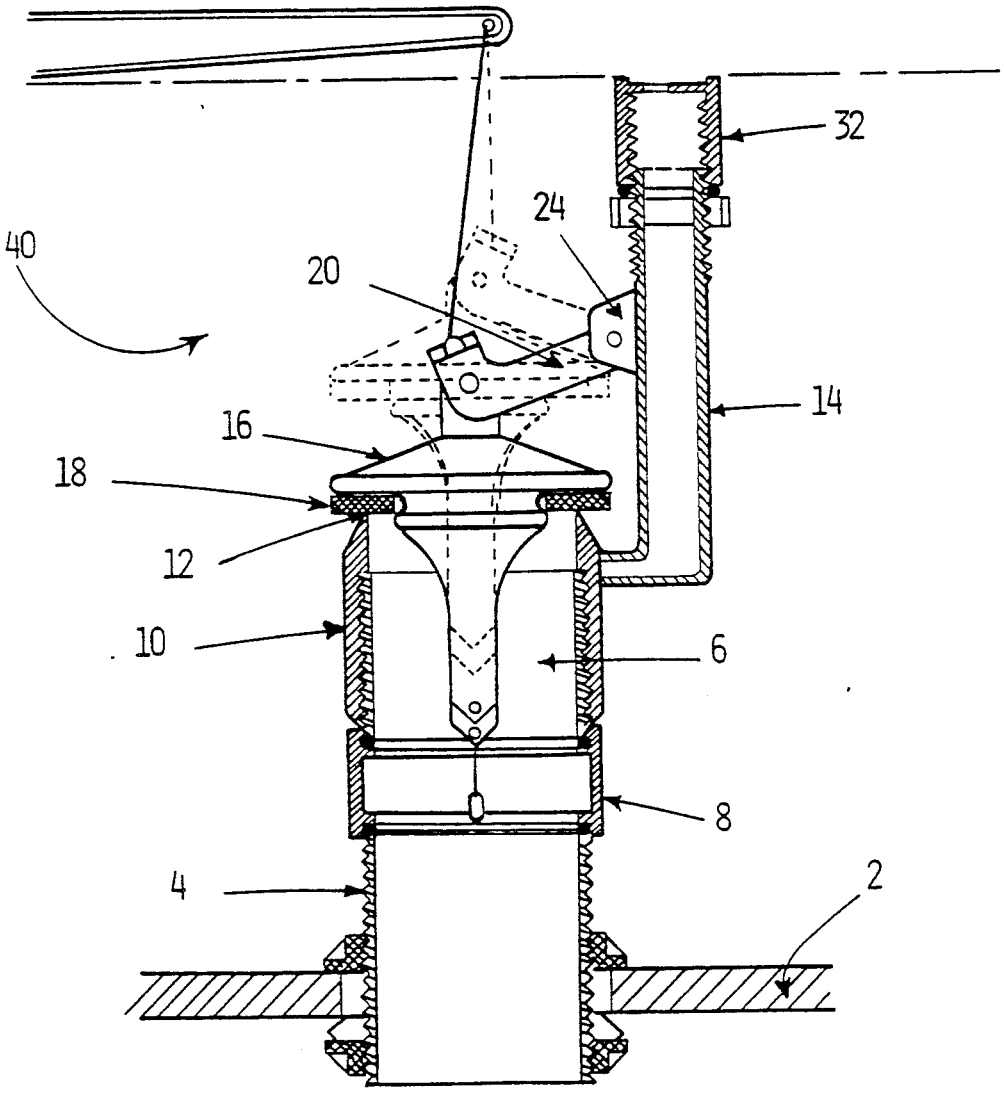
FIG. 1 is a frontal view of the system in its embodiment with one flushing valve, represented substantially in sections.

FIG. 1 represents the water optimizing system of this invention, shown in its first embodiment where a single valve water flushing assembly is used. This system, identified with number 40, is connected to the discharge orifice of tank 2 via a discharge pipe 4 through which the desired water volume is displaced to the toilet bowl. This discharge pipe 4 is threaded along its entire external surface to couple by threads with the tank 2 provided with some threads for this purpose, allowing this threaded coupling to adjust the height of the valve seat from the tank bottom and thereby, the volume of water to be flushed.

The system 40 also includes a water passage 6 that has threads on the external surface to receive by threaded connection an end tubular portion 10 whose upper end is the valve seat 12. The threaded connection of passage 6 and portion 10 represents another of the possible adjustment points for adjusting the height of the system, and thereby the optimum volume of water to be used. As an integral part of the tubular portion 10 there is an overflow pipe 14 on whose upper end portion there is a section with threads to receive by coupling an adjustment element 32 that will in turn adjust the maximum height of the water level inside the tank. For this first embodiment, an interconnection element 8 that has threaded ends is arranged between the discharge pipe 4 and the tubular portion 6 for joining them by threaded connection.

With respect to the flushing valve 16, it consists of a hydrodynamic body of rigid material that can be manufactured, for example, by blowing. The rigid consistency of this valve avoids it undergoing deformations, thereby ensuring greater operating time.

This valve 16 is also characterized in that it has a flat seating surface to perform sealing of the water passage 6 on a horizontal plane. In order to ensure the water tightness of this valve, a ring 18 of resilient material has been provided whose soft nature will allow it to give under hydraulic pressure on the valve, thus sealing the system and avoiding water leaks. This resilient ring 18 can be easily substituted when its properties have been worn down to the point that it does not efficiently perform its duty.

Forming an integral part of the overflow pipe 14 there is a projection 24 where the end of a lift bar 20 that serves to raise the body of the flushing valve 16, is connected in a pivotal manner. The opposite end of this bar 20 is fastened to an upper protuberance 22 which is an integral part of valve 16. The connection of this bar 20 with the protuberance 22 is of such a type that in the raised position of the valve, that is, when water is being flushed toward the toilet bowl, the valve 16 remains in a vertical plane as indicated in FIG. 1 with dotted lines. In order to limit the pivotal ascending movement of bar 20 to a certain degree when the system is activated, the projection 24 also acts a stop element.

Another important characteristic of the flushing valve 16 consists in a lower protuberance 28 with a hydrodynamic form, whereby it is ensured that this valve returns to its correct sealing position after it has been activated. This protuberance 28 has the advantage that it does not obstruct the flow of the water that is being discharged when the system is activated, as distinguished from ballast elements presently used in some models of valves. Alternatively, perforations 33 can be made in the protuberance 28 longitudinally so that the valve 16 can ballasted through them with the introduction of water, if this becomes necessary.

As can be seen in FIG. 1, the water flushing level of the flushing system in its simple embodiment can be adjusted from the junction of this system with the tank or from the threaded connection between the tubular portion 10 and the water passage 6. On these two points, indistinctly, the level of the discharge mouth or valve seat 12 of the . system can be raised or lowered. To compensate the necessary height of the overflow pipe 14, depending on the adjustments made in the abovementioned parts of the system, the height of the element 32 is regulated in such a way that its terminal end is always slightly above the water level in the tank. To do this, such element 32 is lowered or raised by turning it in the positive or negative direction.

To ensure the water-tightness of the system at the different adjustment points, each threaded connection has been provided with a ring seal element 34 and a lock nut element 41 wherewith any leaks in the system are avoided. With respect to the water-tightness required in the place where the system connects with the tank bottom 2, there is a conventional sealing arrangement such as, for example, that indicated in FIGS. 1 and 2.

Figure 2:
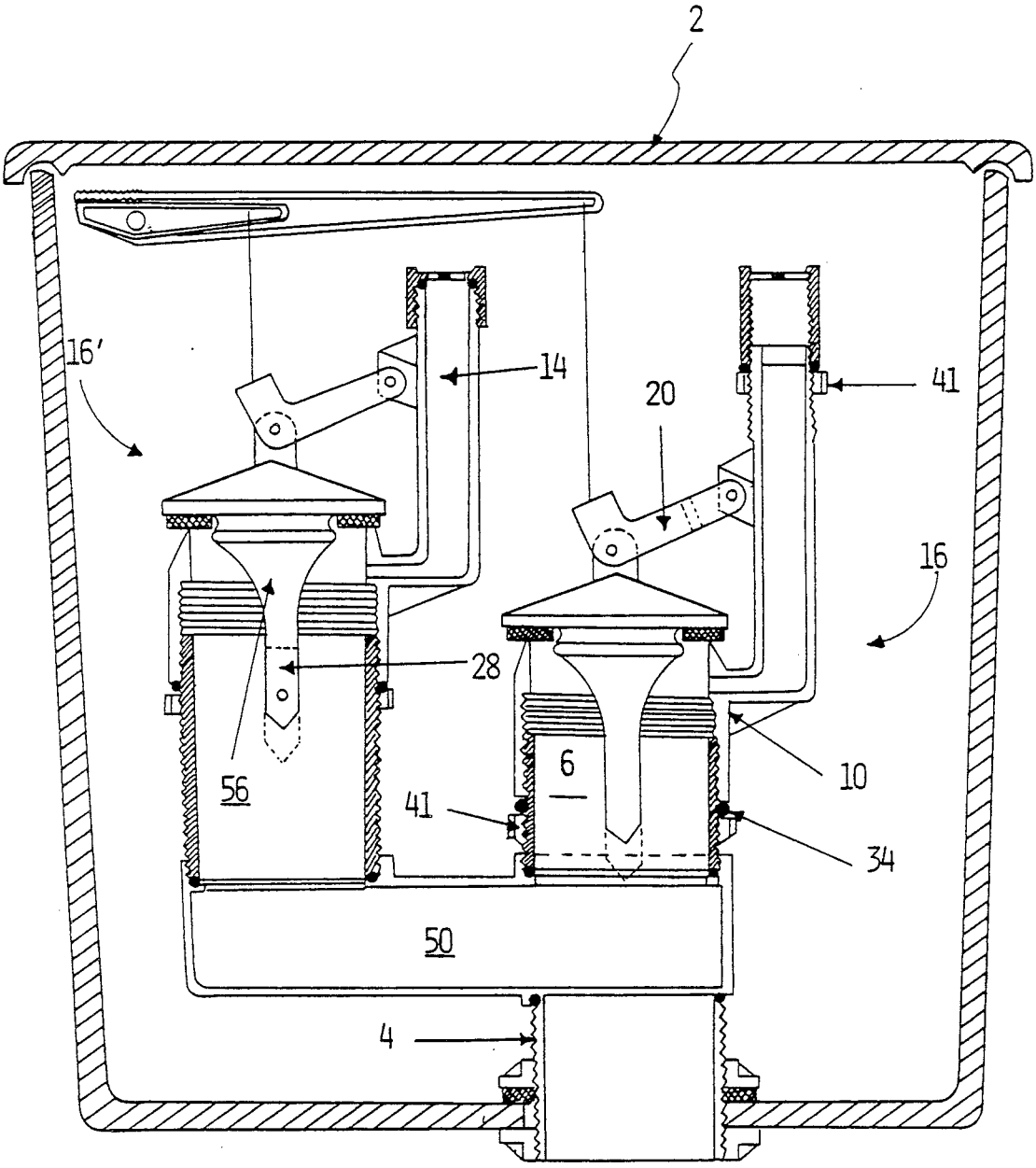
FIG. 2 is a sectional frontal view of the system of this invention, in another embodiment that includes two flushing valves at different levels inside the flush tank.

Referring now to FIG. 2, the water optimizing system is shown in its second embodiment which consists of a water flushing unit that includes a pair of flushing valve assemblies (16,16') that are regulated "in situ" at will to select the optimum water volume for operating this system efficiently. The flushing valve 16 will provide the maximum flushing volume of the system while the valve 16' will define the water volume of the minimum flush of said double system.

Figure 3:
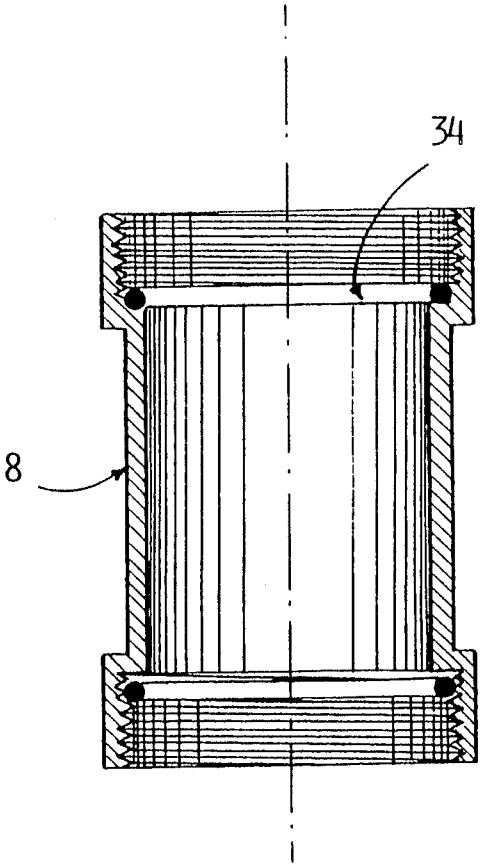
FIG. 3 is a frontal sectional view of an interconnection element used in the system of FIG. 1.
Figure 4:
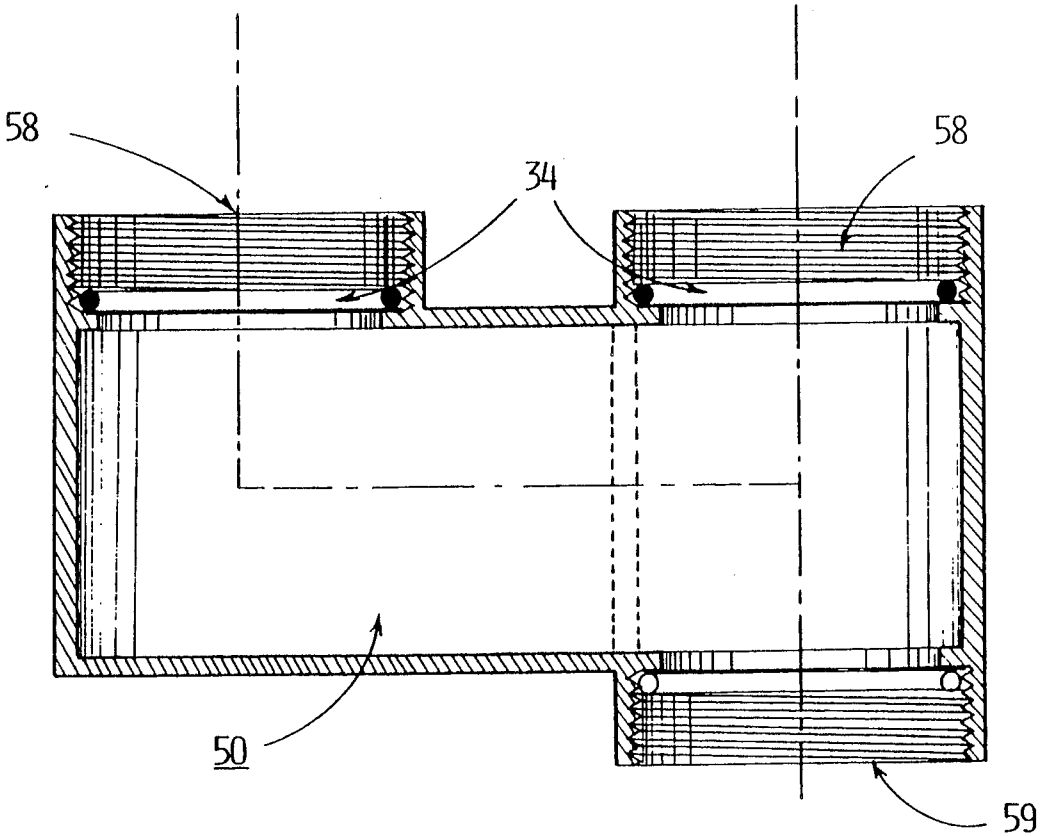
FIG. 4 represents a frontal view of a sectioned communicating chamber to be used in the double valve system of FIG. 2.

In its double flush embodiment, the system is made up of a pair of flushing valve assemblies (16,16') which are exactly the same as to main structure, that is, they include respectively a valve body 56, a water passage 6, an end tubular portion 10 provided with its integral overflow pipe 14 and the same lifting system of the valve body 56 via a lift bar 20. The main difference in the case of this second embodiment, as well as its double discharge, consists in a flushing valve communicating chamber 50 including a pair of upper orifices 58 with a short threaded portion to receive a flushing valve assembly in each orifice and a lower water passage 59 also provided with threads for connection with the main discharge pipe 4 through which the water is evacuated toward the toilet bowl when either of the two valves 16, 16' is activated. FIGS. 3 and 4 illustrate the interconnection elements used, respectively, for the single valve system and the double valve system.

In order to operate the system of FIG. 2, that is, the double valve system, a double action mechanism 60 has been designed that includes a first handle 62 for maximum discharge of water and a second handle 64 for minimum discharge of water. These handles have been shaped especially so that, as can be seen in FIG. 5, in the assembled condition they form a complementary, esthetically pleasing whole, where the handle 64 will govern the minimum flush valve and the handle 62 will allow maximum water flush of the system.

Figure 5:
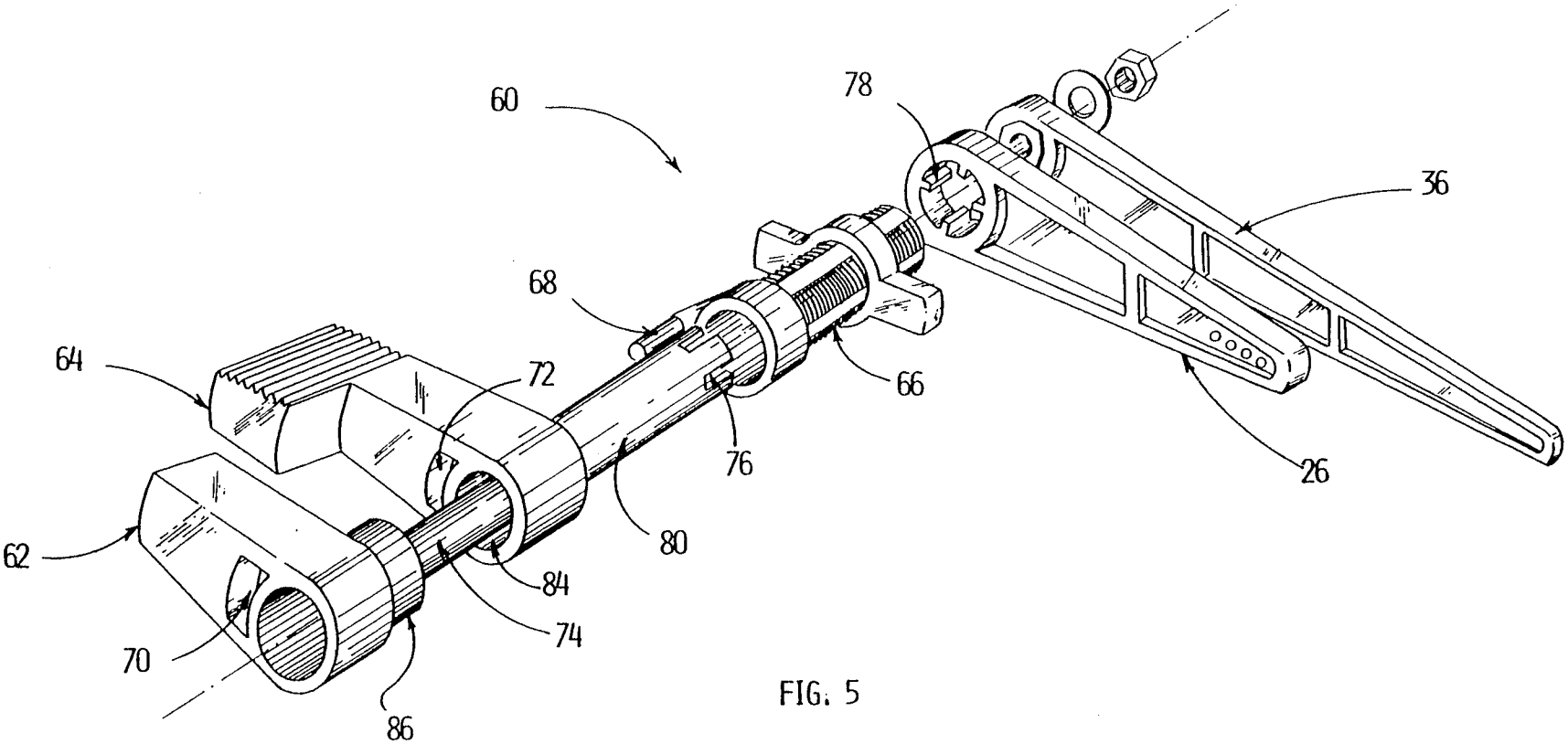
FIG. 5 shows the double activation mechanism in perspective, shown with its separate parts, especially proper for the system of FIG. 2.
Figure 6:
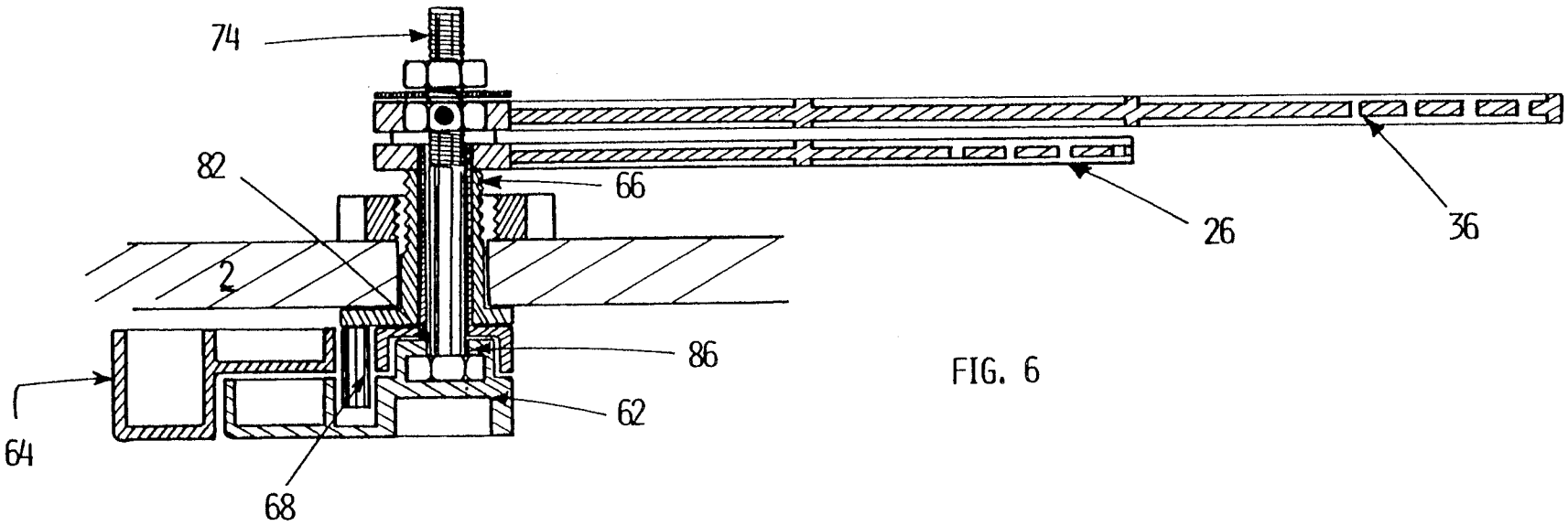
FIG. 6 is an upper view of the sectioned activation mechanism in the position of installation in the tank.
Figure 7:
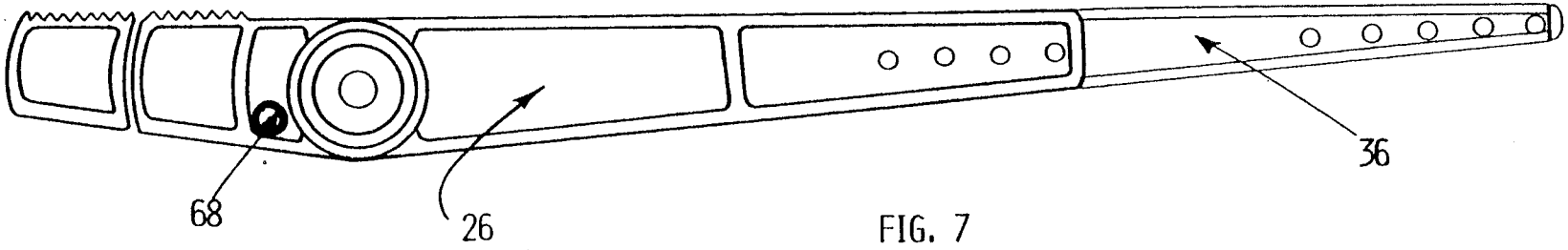
FIG. 7 is a side view of the activation mechanism of this invention.

The connection of the handles to their respective elevation arms 26, 36 of the valves is also innovative, as it is performed via a set of concentric tubular elements and no modification of the conventional systems is needed for installation, that is, the common perforation of the tanks presently in operation allows easy adaptation of the activating mechanism of FIG. 5. For purposes of installation, a threaded fixing element 66 is employed which incorporates bolt 68 the length of which is sufficient to be lodged in grooves 70, 72 practiced in the handles 62, 64 of the activation mechanism 60. The bolt 68 has the purpose of limiting the range of descending movement of the handles when they are activated by the user.

For connecting the handle 64 to its corresponding valve elevation arm 26, handle 64 is provided with an elongate tubular portion 80 that longitudinally traverses element 66, the portion end farthest from the handle having notches 76 for engagement with the arm 26 in a male-female type connection by means of a socket with projection 78 formed on the elevation arm 26. In turn, the handle 62, which activates the maximum flush valve assembly, has a protuberance 86 wherein a metal pin 74 is embedded and that extends from said handle 62, going through the handle 64, via a hole 82 therein, the element 66 and the short arm 26 until reaching its corresponding arm 36, said metal pin 74 having a terminal threaded section at its end most remote from the handle 62 to receive a conventional fixing element. Although a metal pin 74 is proposed for the case of the handle 62, a similar element of any other material can be used, provided it is capable of resisting the stress to which it will be subject in each activation of the handle 62.

Intentionally, the larger area handle 64 has been selected for activating the minimum water flush assembly. Due to the greater accessibility of said handle 64 and with the appropriate signal it will contribute to flush a lower water volume in the tank when so required.

Figure 8:
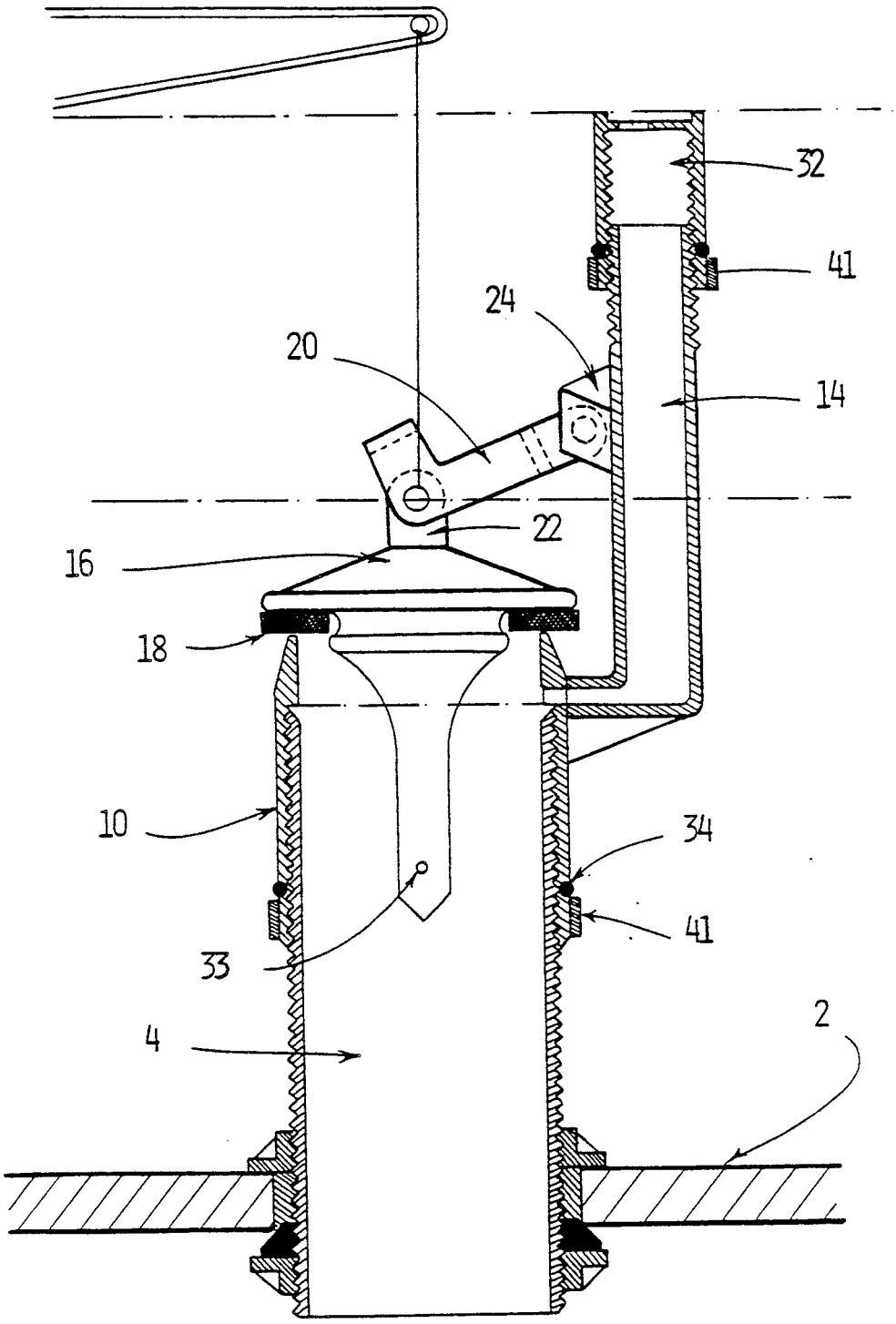
FIG. 8 represents an alternate embodiment of the optimizing system that has a flushing assembly with only one valve.
Figure 9:
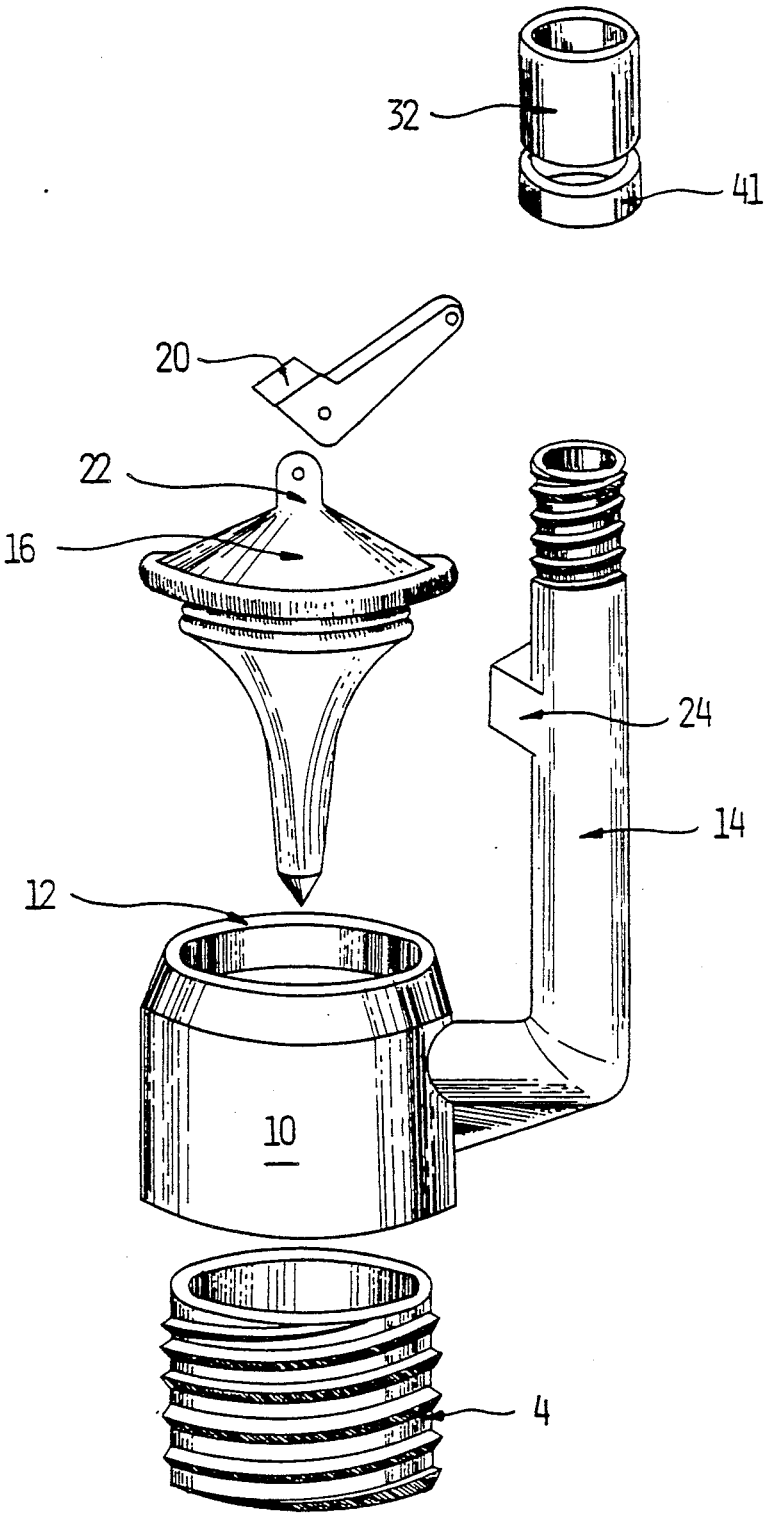
FIG. 9 is a blown up view of the flushing valve assembly used indistinctly for the single or double flushing system.

FIG. 8 shows an example of a still simpler embodiment of the optimizing system in which it can be seen that the discharge pipe 4 is connected with threads directly to the tubular portion 10. Thus, it is avoided using the interconnection element 8 illustrated in FIG. 3. This alternate embodiment makes possible adjustment of the system by means of the threaded coupling of the discharge pipe 4 with the orifice at the bottom of the tank 2 or by means of threaded coupling between the discharge pipe 4 and the tubular portion 10.

I claim:

1. A water optimizing system for toilets of the type that have a flush tank for containing a particular volume of water, said system comprising:

(1) an adjustable single valve water flush assembly placed inside the tank, which comprises:

(a) a water discharge pipe threaded on external surface which is connected with the tank bottom with respect to which said pipe can move selectively upward and downward;

(b) a tubular portion whose upper end defines a valve seat that surrounds a water discharge orifice and that is provided with interior threads for threaded connection with the upper section of the discharge pipe, which threaded connection allows the tubular portion to raise and lower selectively a determined distance along the discharge pipe;

(c) an overflow pipe integrated to the tubular portion that includes an adjustment element on an upper end that is provided with threads, as well as a fastening and stop element;

(d) a valve body for sealing the discharge orifice in the tubular portion;

(e) a valve body lift bar, one end of which is connected with the fastening and stop element for pivotal movement and whose other end is connected to the valve body in order to move it from its sealing position;

(2) and a mechanism for activating the optimizing system that comprises at least one elevation arm that is connected to the lift bar to selectively raise such bar, thereby clearing the discharge orifice of the assembly.

2. The system of claim 1, wherein the threaded connection of the water discharge pipe and the tubular portion makes it possible to adjust the height of the valve seat in order to define in the tank the water level to be flushed.

3. The system of claim 1, wherein the adjustment element of the overflow pipe comprises an internally threaded tubular member that couples with the threaded upper end of the overflow pipe with respect to which it can move up or down selectively.

4. The system of claim 1, wherein the valve body includes a resilient sealing ring on a surface that sits on the valve seat.

5. The system of claim 1, wherein the valve body also includes a lower protruberance that acts as a guide and ballast thereof, the lower proturberance comprising an elongate hollow body capable of being ballasted by means of the introduction of liquid into said protuberance through perforation made in said protuberance.

6. The system of claim 1, wherein the connection of the lift bar and the valve body is of the play type so that such valve body is kept vertical, even when it is raised from the valve seat.

7. The system of claim 1 wherein there is a sealing element and a lock nut element in each threaded coupling of the flush assembly in order to seals such connections and avoid leaks in them.

8. The system of claim 1 further including a tubular interconnection element coupled between a threaded sleeve attached to said tubular portion and said discharge pipe and having threaded end sections and being adapted to connect the discharge pipe with said threaded sleeve.

9. The system of claim 8, wherein the threaded sleeve is an externally threaded tubular element for coupling with the threaded tubular portion so that said portion can go up or down selectively.

10. A water optimizing system for toilets of the type that have a flush tank to contain a particular volume of water, said system comprising:

(1) a water discharge pipe whose external surface is completely threaded and that couples with an exit orifice on the bottom of the tank with respect to which such pipe can be moved selectively up or down;

(2) a valve communicating chamber that comprises a hollow body that has on its upper part a first and a second threaded orifices and on the lower part a threaded flush passage for coupling with the discharge pipe;

(3) a first and a second adjustable water flush assemblies placed in parallel to each other and at a different height with respect to the tank bottom in order to define respective water levels for maximum and minimum flush; each adjustable assembly comprising:

(a) a water passage whose exterior surface is completely threaded and which connects with one of the first and second threaded orifices of the communicating chamber;

(b) a tubular portion whose upper end defines a water flush orifice surrounded by a valve seat, which tubular portion is provided with interior threads for adjustable threaded coupling with an upper section of the respective water passage in such a way that such portion can raise and lower selectively in order to adjust the height of the valve seat of the corresponding assembly; the tubular portion also includes an adjustable, integrated overflow pipe which incorporates threaded adjustment element and a fastening and stop element;

(c) a valve body to seal the flush orifice of the tubular portion, and (d) a valve body lift bar secured to the fastening and stop element for pivotal movement and connected to the valve body to withdraw it from its sealing position;

(4) and an activation mechanism that comprises a first and a second elevation arms, the first arm being connected to the lift bar of the valve body of the first water flush assembly and the second arm being connected to the lift bar of the valve body of the second water flush assembly, and a first and a second handles functionally associated, respectively, with the first and the second elevation arms in order to activate the maximum and minimum flush of the optimizing system.

11. The system of claim 10, wherein the water passage of the first adjustable water flush assembly is shorter than the water passage of the second adjustable water flush assembly.

12. The system of claim 10, wherein there is a ring sealing element in the first and second orifices and in the threaded flush passage of the valve communicating chamber to ensure that the threaded connections in these sites are watertight.

13. The system of claim 10, wherein the tubular portions of the first and second adjustable water flush assemblies are identical.

14. The system of claim 10, wherein the adjustment element of the overflow pipe of the first adjustable water flush assembly is longer than the adjustment element of the overflow pipe of the second adjustable water flush assembly.

15. The system of claim 10, wherein the valve bodies for the first and second adjustable assemblies are identical and comprise a lower protuberance that serves as guide and ballast to secure the adequate positioning of such valve bodies, the lower protuberance having perforations for introduction of water therein.

16. The system of claim 10, wherein the valve body further including a resilient sealing ring arranged on a surface of the body that sits on the valve seat of the corresponding adjustable assembly.

17. The system of claim 10, wherein the lift bars of the valve body of the first and second adjustable assemblies are identical and are connected to respective valve bodies via play coupling so that said bodies are maintained vertically even when they are raised from their sealing position.

18. The system of claim 10, wherein the first and second water flush adjustable assemblies include a lock nut element and a ring seal element to ensure the threaded coupling of the water passage with the tubular portion in each assembly.

19. The system of claim 10, wherein the adjustment element of the overflow pipe of each adjustable assembly further incorporates a ring sealing element for watertight threaded coupling thereof with the respective overflow pipe.

20. The system of claim 10, wherein the first handle has a pin embedded in it which extends from it to the first elevation arm wherewith it connects via a fixing element.

21. The system of claim 10, wherein the second handle includes an extension having notches in a farthest end, said extension connecting with a socket with projections on the second elevation arm.

22. The system of claim 20, wherein the pin embedded in the first handle is a metal pin threaded on its end farthest from said first handle.

23. The system of claim 21, wherein the extension of the second handle is an elongate, hollow tubular member to allow the metal pin of the first handle to extend through it to the first elevation arm.

24. The system of claim 10, wherein the activation mechanism includes a threaded, elongate body to fix said mechanism to the flush tank.

25. The system of claim 24, wherein the elongate fixing body has a longitudinal perforation through which extensions of the first and second handles extend to connect, respectively, with the first and second elevation arms.

26. The system of claim 10, wherein the first and second handles include a groove which receives a bolt projecting from an elongate fixing body to limit the range of activation movement of each handle.

27. The system of claim 26, wherein the grooves of the first and second handles, in their non-activated condition are in registration.

28. The system of claim 10, wherein the second handle has a perforation in one of its ends through which passes a metal pin of the first handle to connect with the first elevation arm.

29. The system of claim 28, wherein the second handle has a circular recess adjacent to its perforation where a protuberance in the first handle lodges.

30. The system of claim 29, wherein one end of the metal pin is embedded in the protuberance of the first handle.

* * * * *